US010286527B2

(12) United States Patent
Chen

(10) Patent No.: US 10,286,527 B2
(45) Date of Patent: May 14, 2019

(54) HEXAGONAL WRENCH

(71) Applicant: Joun-Jan Chen, Taichung (TW)

(72) Inventor: Joun-Jan Chen, Taichung (TW)

( * ) Notice: Subject to any disclaimer, the term of this patent is extended or adjusted under 35 U.S.C. 154(b) by 277 days.

(21) Appl. No.: 15/469,484

(22) Filed: Mar. 24, 2017

(65) Prior Publication Data

US 2018/0272508 A1 Sep. 27, 2018

(51) Int. Cl.
*B25B 15/00* (2006.01)

(52) U.S. Cl.
CPC ..... *B25B 15/008* (2013.01); *B25B 15/005* (2013.01)

(58) Field of Classification Search
CPC .... B25B 15/008; B25B 15/005; B25B 15/001
See application file for complete search history.

(56) References Cited

U.S. PATENT DOCUMENTS 2,800,829 A * 7/1957 West ..... B25B 15/005 411/404
2,800,936 A * 7/1957 West ..... B25B 15/005 81/460
8,448,547 B2 * 5/2013 Whitehead ..... B25B 27/18 81/441
9,061,401 B2 * 6/2015 Lin ..... B25B 15/001
2005/0166724 A1 * 8/2005 Castaneda ..... B25B 15/008 81/436
2016/0332285 A1 * 11/2016 Chen ..... B25B 15/008

* cited by examiner

*Primary Examiner* — David B. Thomas

(57) ABSTRACT

A hexagonal wrench includes a body with at least one function end which is a twisted and equal-sided column. The twisted and equal-sided column includes a root section, an end section and a middle section which formed between the root section and the end section. A maximum twist angle is defined between the root section and the end section, and the maximum twist angle is equal to or less than 30 degrees. The root section has a first cross section and the end section has a second cross section. The first cross section is larger than second cross section.

14 Claims, 9 Drawing Sheets

HEXAGONAL WRENCH

BACKGROUND OF THE INVENTION

1. Fields of the Invention

The present invention relates to a hexagonal wrench, and more particularly, to a hexagonal wrench having a function end which is twisted an angle relative to the axis of the body.

2. Descriptions of Related Art

The conventional hexagonal wrench is disclosed in FIG. 17 and comprises a body 30 having at least one function end 31 which has a hexagonal cross section. The function end 31 includes six straight ridges 32 which are parallel to each other. Nevertheless, when the function end 31 is used to rotate an object 20 having a recess composed of six sides 21, the function end 31 cannot be tightly in contact with the six sides 21. Each straight ridge 32 contacts one of the six sides 21 at only one point. When rotating the function end 31, the object 20 may not be successfully rotated. Assume that each straight ridge 32 contacts multiple points on the side 21 corresponding thereto, the multiple points are located along a straight line. In this case, the object 20 may not be successfully rotated.

Another conventional hexagonal wrench is disclosed in U.S. Pat. No. 5,105,690 and comprises a body 10 with a function end which has a cross section that has an even size. The function end includes a first driving portion and a second driving portion, and both driving portions have a hexagonal cross section. The first driving portion has an inclination angle. The first driving portion has substantially the same structure as the function end so that the first driving portion has multiple contact point with each of the six sides of the object, these contact points are located along a straight line.

The present invention intends to provide a hexagonal wrench which improves the shortcomings mentioned above.

SUMMARY OF THE INVENTION

The present invention relates to a hexagonal wrench and comprises a body with at least one function end which is a twisted and equal-sided column. The twisted and equal-sided column includes a root section, an end section and a middle section which formed between the root section and the end section. A maximum twist angle is defined between the root section and the end section, and the maximum twist angle is equal to or less than 30 degrees. The root section has a first cross section and the end section has a second cross section. The first cross section is larger than second cross section.

The primary object of the present invention is to provide a hexagonal wrench wherein there are multiple points between the function end and the recess of an object so as to improve the problems happened to the conventional hexagonal wrenches. When the object is rotated, every side of the recess may not be deformed in the same way, so that the spiral function end has high possibility of multiple contact points with each side of the recess of the object.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
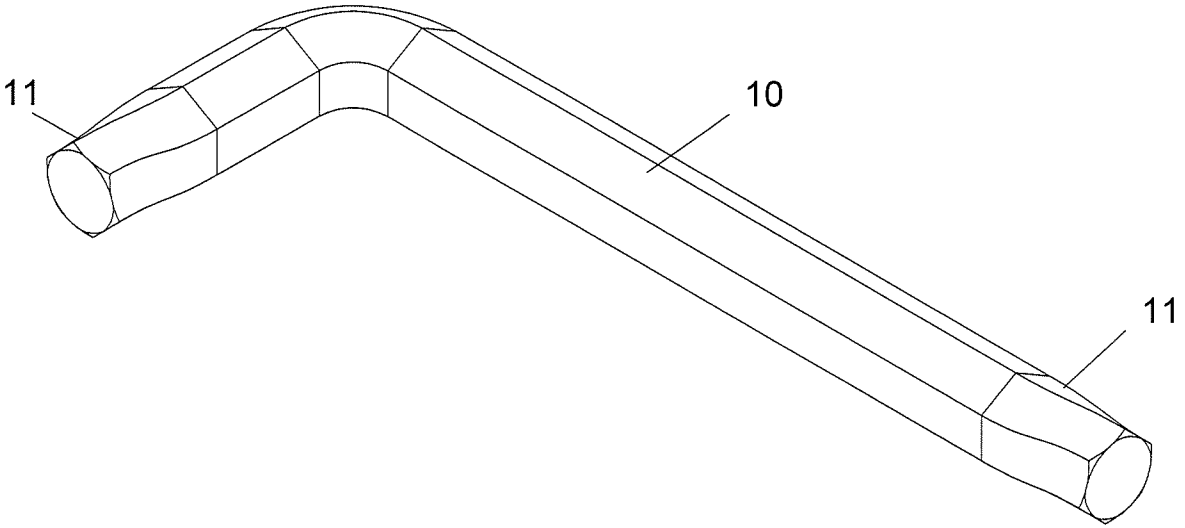
FIG. 1 is a perspective view to show the hexagonal wrench of the present invention.
Figure 4:
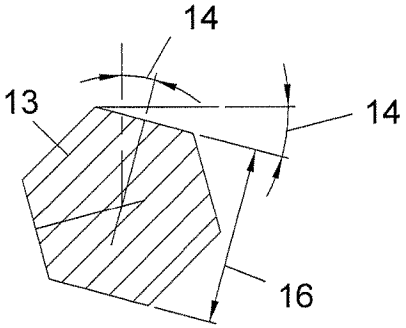
FIG. 4 is a cross sectional view, taken along line 4-4 in FIG. 2.
Figure 3:
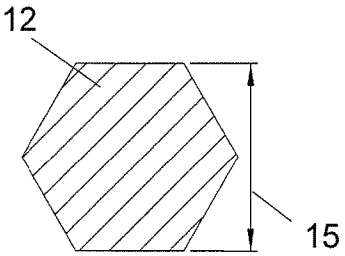
FIG. 3 is a cross sectional view, taken along line 3-3 in FIG. 2.

Referring to FIGS. 1 to 4, the hexagonal wrench of the present invention comprises a body 10 having a function end 11 formed on each of two ends of the body 10. The body 10 is a hexagonal column and is an L-shaped body. The two respective axes of the two function ends 11 are perpendicular to each other.

Each function end 11 is a twisted and equal-sided column, and the twisted and equal-sided column includes a root section 110, an end section 111 and a middle section 112 which formed between the root section 110 and the end section 111. A maximum twist angle 14 between the root section 110 and the end section 111 is equal to or less than 30 degrees. Preferably, the maximum twist angle 14 is between 10 to 15 degrees.

The root section 110 having a first cross section 12 which has a first shortest distance 15 between two opposite sides thereof. The end section 111 has a second cross section 13 which has a second shortest distance 16 between two opposite sides thereof. The second shortest distance 16 is smaller than the first shortest distance 15. In other words, the first cross section 12 is larger than second cross section 13. The second shortest distance 16 is more than 0.8 time of the first shortest distance 15. Preferably, the second shortest distance 16 is more than 0.9 or 0.95 time of the first shortest distance 15.

Figure 5:
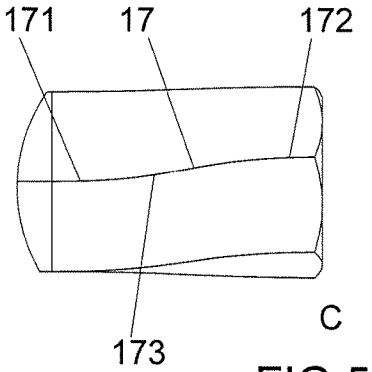
FIG. 5 is an enlarged view of the circled "C" in FIG. 2.
Figure 2:
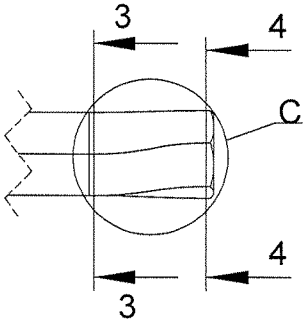
FIG. 2 is a top view of the hexagonal wrench of the present invention.
Figure 2:
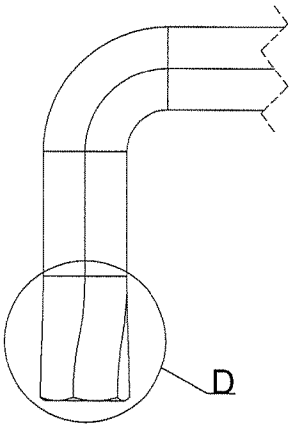
Figure 6:
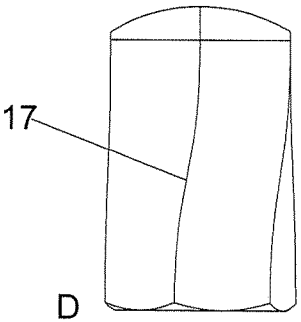
FIG. 6 is an enlarged view of the circled "D" in FIG. 2.

As shown in FIGS. 5 and 6, each point of each of the cross sections along with the root section 110 forms a first section 171. Each point of each of the cross sections along with the end section 111 forms a second section 172. Each point of each of the cross sections along with the middle section 112 forms a third section 173. The first section 171 is perpendicular to the first cross section 12. The second section 172 is perpendicular to the second cross section 13. The third section 173 is a spiral line whose two ends are tangent to the first and second sections 171, 172. The two function ends 11 twist in opposite directions. The angle that the two function ends 11 twist is the same.

The function ends 11 are manufactured by way of cutting. That is, a knife is moved along the spiral line 17 so that the knife repeatedly cut the column six times to form the function end 11.

Figure 7:
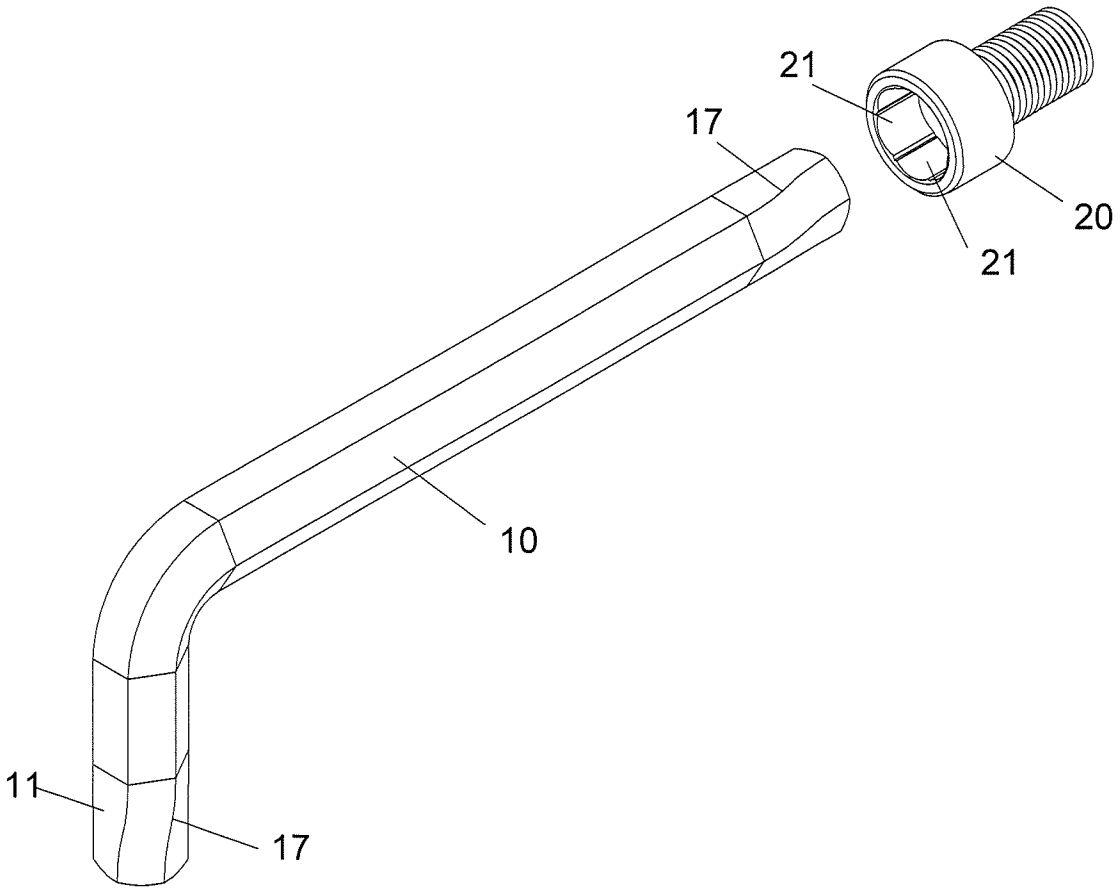
FIG. 7 shows the hexagonal wrench of the present invention and a bolt.
Figure 8:
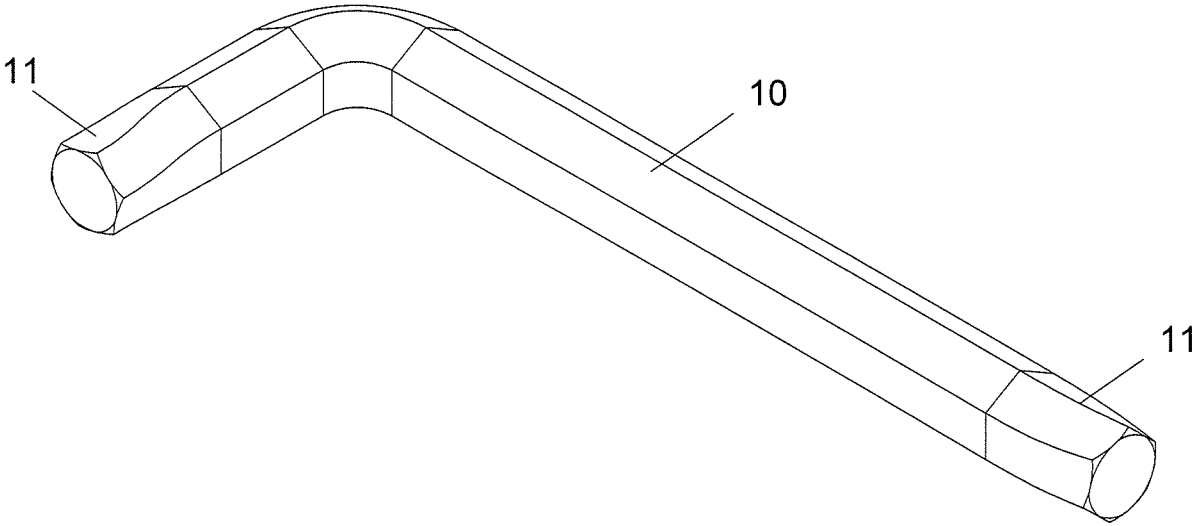
FIG. 8 is a perspective view to show the second embodiment of the hexagonal wrench of the present invention.
Figure 9:
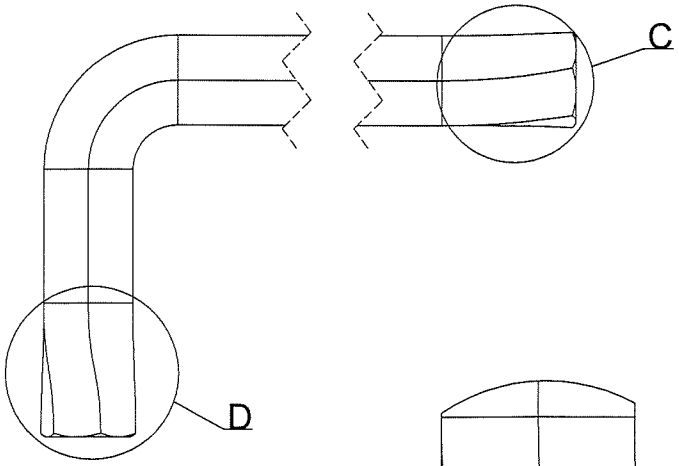
FIG. 9 is a top view to show the second embodiment of the hexagonal wrench of the present invention.
Figure 10:
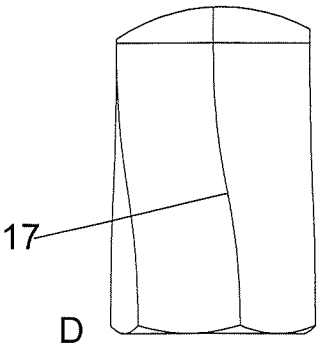
FIG. 10 is an enlarged view of the circled "C" in FIG. 9.
Figure 11:
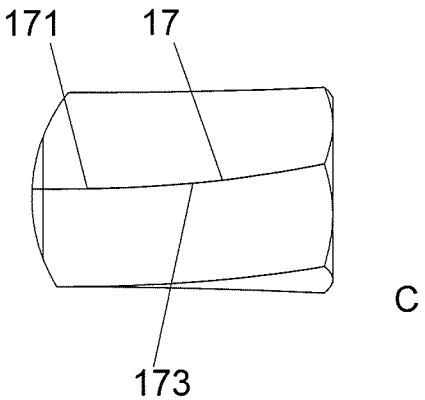
FIG. 11 is an enlarged view of the circled "D" in FIG. 9.

As shown in FIG. 7, the object 20 such as the bolt as disclosed includes a hexagonal recess which includes side sides 21 which are in contact with the function end 11.

As shown in FIGS. 8 to 11, the two function ends 11 twist in the same direction. The second section 172 and the third section 173 extend along a common spiral line, and one end of the third section 173 is tangent to the first section 171. The first section 171 is perpendicular to the first cross section 12.

Figure 12:
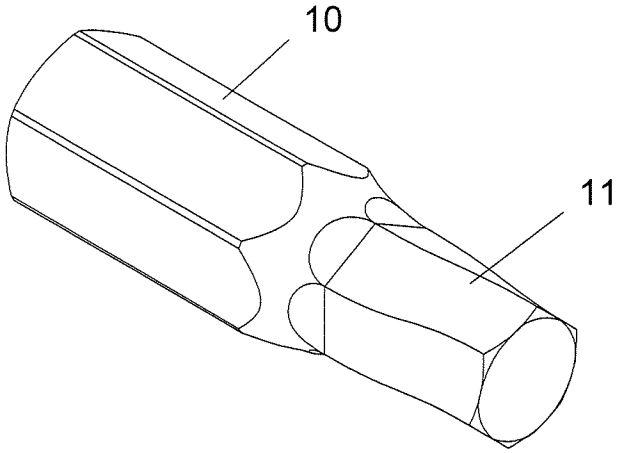
FIG. 12 is a perspective view to show the third embodiment of the hexagonal wrench of the present invention.

FIG. 12 shows that the body 10 is hexagonal column and made to be screwdriver bit. The function end 11 tilts toward the distal end thereof, and has the function end 11 on one end thereof.

Figure 13:
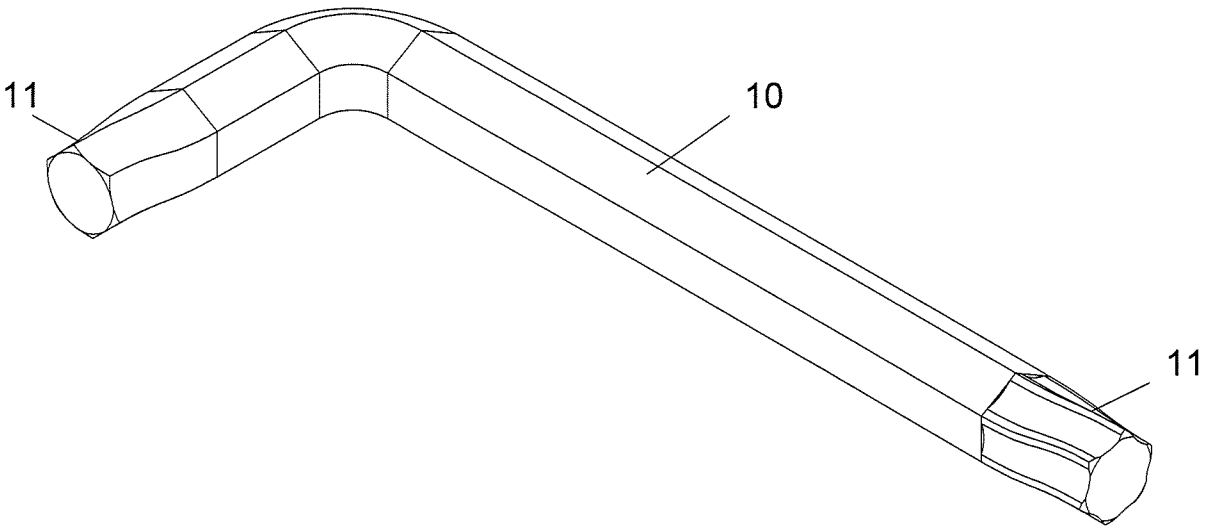
FIG. 13 is a perspective view to show the fourth embodiment of the hexagonal wrench of the present invention.

FIG. 13 shows that the function end 11 is a hexagonal column which has a star-shaped cross section.

Figure 16:
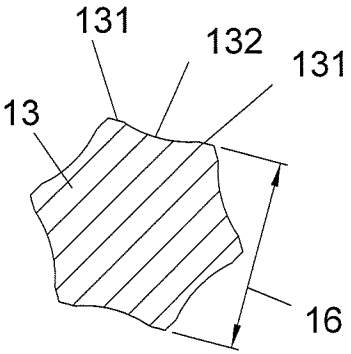
FIG. 16 is a cross sectional view, taken along line 16-16 in FIG. 14.
Figure 15:
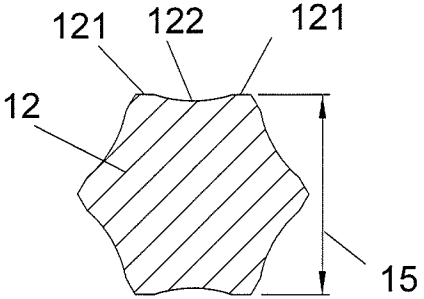
FIG. 15 is a cross sectional view, taken along line 15-15 in FIG. 14.
Figure 14:
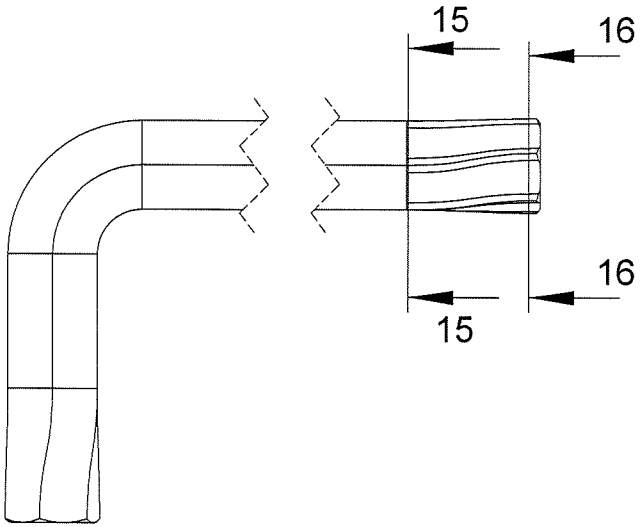
FIG. 14 is a top view to show the fourth embodiment of the hexagonal wrench of the present invention.
Figure 17:
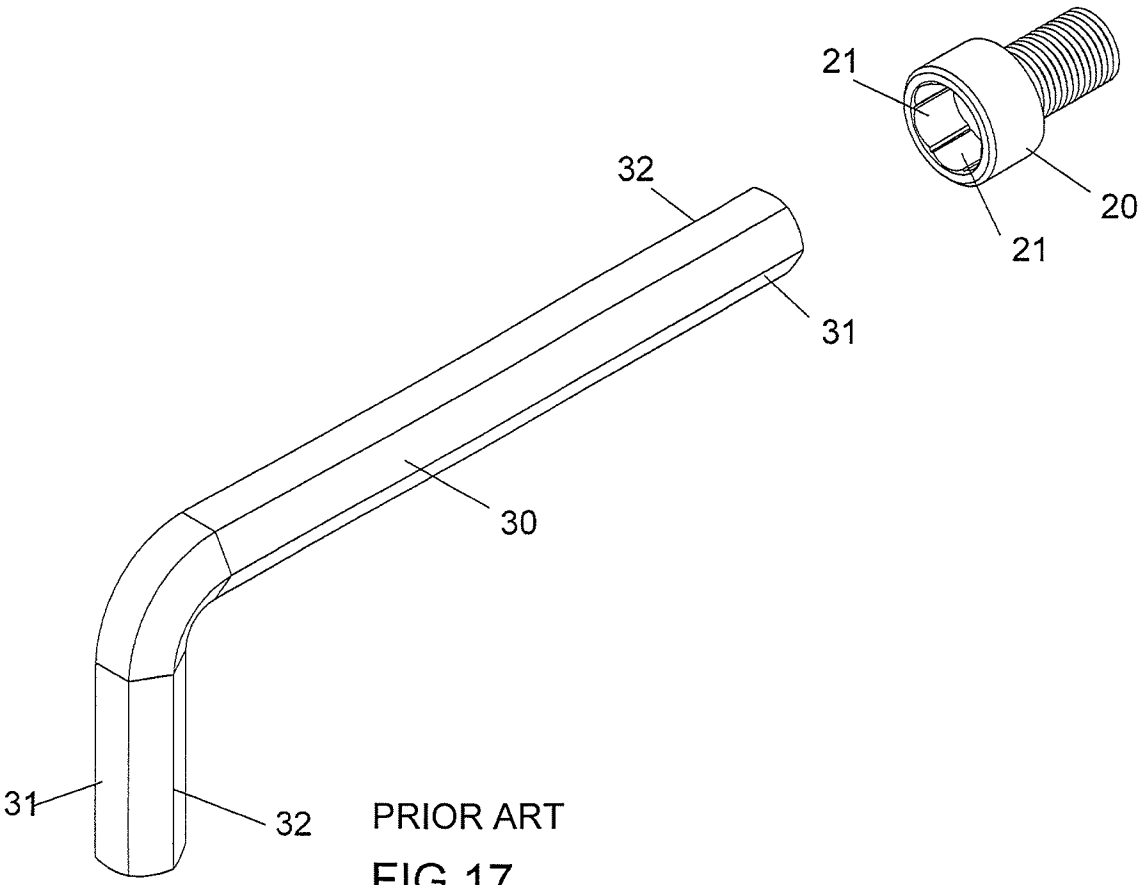
PRIOR ART FIG.17
FIG. 17 shows a conventional hexagonal wrench and a bolt.

As shown in FIGS. 14 to 16, the function end 11 of the body 10 has a first cross section 12 which is a star-shaped cross section. Each side of the first cross section 12 includes two first straight sections 121 and a first curved section 122. The center of the first curved section 122 is located outside the body 10 and located between the two first straight sections 121. The two first straight sections 121 are located symmetrically to the first curved section 122. The second cross section 13 is substantially star-shaped and each side of the second cross section 13 includes two second straight sections 131 and a second curved section 132. The center of the second curved section 132 is located outside the body 10 and located between the two second straight sections 131. The two second straight sections 131 are located symmetrically to the second curved section 132.

Each side of the first cross section 12 of the function end 11 of the present invention is parallel to the horizontal plane, and the maximum twist angle between each side of the second cross section 13 of the function end 11 is 14 degrees.

The root section 110 having a first cross section 12 which has a first shortest distance 15 between two opposite sides thereof. The end section 111 has a second cross section 13 which has a second shortest distance 16 between two opposite sides thereof. The second shortest distance 16 is smaller than the first shortest distance 15. In other words, the first cross section 12 is larger than second cross section 13.

The spiral line 17 is formed between the first and second cross sections 12, 13. The spiral line 17 includes a first section 171, a second section 172 and a third section 173. The first section 171 is perpendicular to the first cross section 12. The second section 172 is perpendicular to the second cross section 13. The third section 173 is tangent to the first section 171 and the second section 172.

The advantages of the present invention are that the maximum twist angle 14 is defined between the first and second cross sections 12, 13. The second cross section 13 is smaller than the first cross section 12.

The function end 11 twists along the spiral line 17. When the function end 11 is engaged with the six-sided recess of the object 20, each spiral line 17 of the function end 11 contacts each of the six sides 21 at one or more than one point so as to form multiple planes, and the function end 11 is able to effectively drive the object 20.

When the object 20 is rotated, every side 21 of the recess may not be deformed in the same way, so that the spiral function end 11 has multiple contact points with each side 21 of the recess of the object 20. In other words, the function end 11 of the present invention is more efficient than the conventional function end to drive the object 20.

The maximum twist angle 14 of the spiral line 17 of the function end 11 is positive angle, so that when the object 20 needs to be rotated clockwise, the function end 11 provides more torque to drive the object 20.

While we have shown and described the embodiment in accordance with the present invention, it should be clear to those skilled in the art that further embodiments may be made without departing from the scope of the present invention.

What is claimed is:

1. A hexagonal wrench comprising:

a body having at least one function end which is a twisted and equal-sided column, the twisted and equal-sided column including a root section, an end section and a middle section which formed between the root section and the end section, a maximum twist angle between the root section and the end section being equal to or less than 30 degrees, the root section having a first cross section which has a first shortest distance between two opposite sides thereof, the end section having a second cross section which has a second shortest distance between two opposite sides thereof, the second shortest distance being smaller than the first shortest distance, the first cross section being larger than second cross section, the second shortest distance being more than 0.8 time of the first shortest distance.

2. The hexagonal wrench as claimed in claim 1, wherein each point of each of the cross sections along with the root section forms a first section, each point of each of the cross sections along with the end section forms a second section, each point of each of the cross sections along with the middle section forms a third section, the first section is perpendicular to the first cross section, the second section is perpendicular to the second cross section, the third section is a spiral line whose two ends are tangent to the first and second sections.

3. The hexagonal wrench as claimed in claim 1, wherein the maximum twist angle is less than 20 degrees.

4. The hexagonal wrench as claimed in claim 1, wherein the maximum twist angle is less than 15 degrees.

5. The hexagonal wrench as claimed in claim 1, wherein the maximum twist angle is between 10 to 15 degrees.

6. The hexagonal wrench as claimed in claim 1, wherein the second shortest distance is more than 0.9 time of the first shortest distance.

7. The hexagonal wrench as claimed in claim 1, wherein the second shortest distance is more than 0.95 time of the first shortest distance.

8. The hexagonal wrench as claimed in claim 1, wherein the body is a hexagonal column and bent to be an L-shape body, each of two ends of the L-shaped column has the function end.

9. The hexagonal wrench as claimed in claim 8, wherein the two function ends twist in opposite directions.

10. The hexagonal wrench as claimed in claim 8, wherein the two function ends twist in the same direction.

11. The hexagonal wrench as claimed in claim 1, wherein each point of each of the cross sections along with the root section form a first section, each point of each of the cross sections along with the end section form a second section, each point of each of the cross sections along with the middle section form a third section, the first section is perpendicular to the first cross section, the second section and the third section extend along a common spiral line, one end of the third section is tangent to the first section.

12. The hexagonal wrench as claimed in claim 1, wherein the body is a screwdriver bit, the body is a hexagonal column and has the function end on one end thereof.

13. The hexagonal wrench as claimed in claim 1, wherein the function end is a hexagonal column which has a star-shaped cross section.

14. The hexagonal wrench as claimed in claim 1, wherein the function end is a spiral and hexagonal equal-sided column.

* * * * *